US008767984B2

(12) United States Patent
Fletcher

(10) Patent No.: US 8,767,984 B2
(45) Date of Patent: Jul. 1, 2014

(54) APPARATUS AND METHOD FOR REPRODUCTION OF STEREO SOUND

(75) Inventor: Edward Stuart Fletcher, Devon (GB)

(73) Assignee: Airsound LLP, London (GB)

( * ) Notice: Subject to any disclaimer, the term of this patent is extended or adjusted under 35 U.S.C. 154(b) by 451 days.

(21) Appl. No.: 12/746,357

(22) PCT Filed: Dec. 8, 2008

(86) PCT No.: PCT/GB2008/004029

§ 371 (c)(1),
(2), (4) Date: Aug. 18, 2010

(87) PCT Pub. No.: WO2009/071911

PCT Pub. Date: Jun. 11, 2009

(65) Prior Publication Data

US 2010/0303264 A1 Dec. 2, 2010

(30) Foreign Application Priority Data

Dec. 6, 2007 (GB) ..... 0723920.5

(51) Int. Cl.
*H04R 5/02* (2006.01)

(52) U.S. Cl.
USPC ..... 381/300; 381/303; 381/89; 381/71.8; 381/332

(58) Field of Classification Search
USPC ..... 381/300, 301, 302, 303, 304, 308, 309, 381/310, 59, 71.8, 71.7, 106, 109, 119, 120, 381/123, 337, 338, 339, 341, 342, 347, 348, 381/349, 350, 351, 352, 354, 160, 161, 162, 381/165, 373, 374, 379, 382, 184, 186, 386, 381/387, 408, 411, 424, 423, 124, 89; 700/94
See application file for complete search history.

(56) References Cited

U.S. PATENT DOCUMENTS

| | | | | | |
|---|---|---|---|---|---|
| 3,588,355 | A | * | 6/1971 | Holm | 81/308 |
| 3,637,938 | A | * | 1/1972 | Kuhlow et al. | 381/308 |
| 3,688,864 | A | * | 9/1972 | Guss | 381/89 |
| 5,073,945 | A | * | 12/1991 | Kageyama et al. | 381/89 |
| 5,109,416 | A | | 4/1992 | Croft | |
| 5,343,535 | A | * | 8/1994 | Marshall | 381/349 |
| 5,898,138 | A | * | 4/1999 | Delgado, Jr. | 181/152 |

FOREIGN PATENT DOCUMENTS

| | | | | |
|---|---|---|---|---|
| EP | 0 725 540 | A | 8/1996 | |
| GB | 2 392 043 | A | 2/2004 | |
| WO | WO 98/42159 | A | 9/1998 | |
| WO | WO 9842159 | A1 * | 9/1998 | H04R 5/02 |
| WO | WO 2007/096610 | A | 8/2007 | |
| WO | WO 2009/071911 | A2 | 6/2009 | |

* cited by examiner

*Primary Examiner* — Leshui Zhang
(74) *Attorney, Agent, or Firm* — Kilpatrick Townsend & Stockton LLP

(57) ABSTRACT

Apparatus for reproduction of stereo sound from a two channel signal, having one or more first transducers (3*a*, 3*b*) for reproducing a signal comprising one of or the sum of the two channels, and one or more second transducers (5) for reproducing a signal comprising the difference between the two channels. The apparatus is arranged such that the signal generated by the one or more first transducers (3*a*, 3*b*) is transmitted from an output plane in a direction substantially orthogonal to the output plane. The apparatus also has a duct (6) associated with the one or more second transducers (5) and is arranged to conduct the signal generated by the one or more second transducers (5) such that it is transmitted along a direction substantially parallel to the output plane from a point spaced from the plane in the direction in which the signal generated by the one or more first transducers (3*a*, 3*b*) is transmitted.

14 Claims, 5 Drawing Sheets

APPARATUS AND METHOD FOR REPRODUCTION OF STEREO SOUND

The present invention relates to sound reproduction and in particular relates to an improved apparatus and method for reproduction of stereo sound.

Stereo sound recording and reproduction employs acoustic projection to encode the relative position of sound sources recorded, and aims to reproduce the sound with a sense of those relative positions. A stereo system can involve two or more channels, but two channels systems dominate for audio recording. The two channels (usually known as left and right) convey information relating to sound fields located to the left and right of a listener. By far the most popular means presently for reproducing two channel stereo signals is to broadcast the channels via two respective, spaced apart, left and right speakers.

Despite its popularity, though, there are disadvantages with this system. Most commercial two channel stereo sound recordings are mixed for optimum reproduction by speakers spaced about 1.6 metres apart. In reality, this is rarely possible, especially where it is desired to reproduce stereo sound from a single loudspeaker enclosure or unit. In any event, however a recording is mixed, the closer the speakers used to transmit the left and right channels are together, the poorer the stereo effect reproduced.

Also, for optimum perception of a stereo effect the listener should be located at the apex of an equilateral triangle made by the pair of speakers and the listener. In reality, though, it is often inconvenient or impossible for a listener to adopt or maintain this position, particularly within commercial premises, such as bars, shops and hotels etc., and of course, it is impossible for multiple listeners to listen from the same position.

An alternative system for reproduction of a two channel stereo signal, which addresses some of the above disadvantages, is disclosed in U.S. Pat. No. 3,588,355 and is known as the sum and difference system. This document discloses a stereophonic loudspeaker system comprising two pairs of loudspeakers. Each pair is oriented with their axes at right angles to each other and substantially equidistant from the point of intersection of the axes. The speakers are so arranged that one speaker of each pair faces the listener and the other speaker has its axis substantially orthogonal to the listener. Means are provided for processing the left and right two-channel stereo signals to provide a sum signal (i.e. left+right) and a difference signal (i.e. left−right). The sum signals are applied in phase to the speakers whose axes are directed toward the listener, and the difference signals are applied to the speakers whose axes are positioned at right angles with respect to the direction of the listener, the difference signals to the two perpendicular speakers being applied 180° out of phase with each other. As a result, a stereophonic sound effect should be produced by the system.

Whilst intended to overcome the problems associated with the use of spaced apart speakers the arrangement of U.S. Pat. No. 3,588,355 has not entered widespread use. This is thought to be because there are practical difficulties with the disclosed apparatus, which result in the actual sound quality, and perceived stereo effect obtained falling below what might theoretically be expected.

Many of the short fallings in the art have been addressed by the apparatus and method disclosed in co-pending international patent application WO 2007/096610, which provides a single loudspeaker enclosure for reliably reproducing a high quality stereophonic sound. The enclosure comprises a forward facing (i.e. towards the direction of the listener) audio loudspeaker that is driven by a sum signal, and a dipole loudspeaker driven by a difference signal, that is disposed generally behind the forward facing loudspeaker. By way of appropriate ducting in the enclosure, the difference signal is transmitted from respective spaced apart locations, so that the signal is transmitted substantially perpendicular to the transmitted sum signal.

However, although enclosures such as the above reproduce high quality stereophonic sound, such arrangements may not be suitable or desirable for all environments, as the arrangement of the loudspeakers may lead to an enclosure that is more intrusive to the listening environment than is actually desired. Therefore, from the point of view of some individuals, the installation of such speaker enclosures may impinge on the aesthetic appeal of the room or listening area. In commercial premises or environments, it is commonly desired for speaker enclosures to have a small visual 'footprint', so that they do not have a marked impact on the visual and aesthetic decoration and design of the premises. Therefore, many architects and interior designers prefer to use compact speaker enclosures, such as flat panel types, that can be fixed to walls or ceilings, and/or embedded therein. However, the use of such enclosures may lead to typically poorer sound reproduction. Hence, although there is need to minimize the size, and in particular the depth, of the enclosure, it is desirable to do so without sacrificing the quality of the reproduced sound.

The present invention seeks to provide an improved apparatus and method for reproduction of stereo sound that enables the apparatus to be mounted in, or to, a surface without significantly protruding/extending beyond the plane of the surface and intruding on the listening environment, while still providing a reliable and high quality reproduction of stereophonic sound.

According to a first aspect of the present invention there is provided an apparatus for reproduction of stereo sound from a two channel stereo signal, comprising:

one or more first transducers for reproducing a signal comprising one of, or the sum of, the two channels, and one or more second transducers for reproducing a signal comprising the difference between the two channels, the apparatus being arranged such that the signal generated by the one or more first transducers is transmitted from an output plane in a direction substantially orthogonal to the output plane;

The apparatus further comprising a duct associated with the one or more second transducers and arranged to conduct the signal generated by the one or more second transducers such that it is transmitted along a direction substantially parallel to the output plane from a point spaced from the plane in the direction in which the signal generated by the one or more first transducers is transmitted.

According to a second aspect of the present invention there is provided a method for reproduction of stereo sound from a two channel stereo signal, comprising the steps of:

providing one or more first transducers for reproducing a signal comprising one of, or the sum of, the two channels, and providing one or more second transducers for reproducing a signal comprising the difference between the two channels;

transmitting the signal generated by the one or more first transducers from an output plane, in a direction substantially orthogonal to the output plane; and conducting the signal generated by the one or more second transducers, via a duct associated with the one or more second transducers, such that it is transmitted along a direction substantially parallel to the output plane from a point spaced from the plane in the direction in which the signal generated by the one or more first transducers is transmitted.

It is thought that the sum and difference system of stereo sound reproduction works by the transmitted sum signal being modified by the transmitted difference signal by varying amounts at different locations to recreate the original recorded sound field, or an approximation of it. The apparatus and method of the present invention recreate a stereophonic sound field by reproducing a sum signal and a difference signal from two or more audio channels in accordance with established techniques of sum and difference processing. Hence, the present apparatus has application with both stereo and multi-channel sound reproduction equipment, such as used in surround sound systems for example.

It is to be appreciated that the apparatus may contain two or more transducers depending on the particular application and desired technique of driving the transducers, while still achieving all of the advantages and benefits of the present invention.

In a preferred embodiment, the one or more first transducers may be a single audio loudspeaker that is driven by the combined (i.e. sum of the) left and right channels of a stereo input signal, so as to reproduce a sum signal that is transmitted into the listening environment. The one or more first transducers are arranged such that the reproduced signal is transmitted from, and substantially orthogonally to, an output plane on or spaced in front of the one or more first transducers. By 'in front of' we mean in the direction of the sum signal and spaced from the transducer.

The one or more second transducers may be a bi-directional loudspeaker and in particular a dipole loudspeaker. The dipole loudspeaker may comprise a driver arranged to drive a loudspeaker element, such as a diaphragm which may be any suitable shape, for example frusto-conical, or substantially flat. The one or more second transducers may be driven to reproduce a signal comprising the difference between the two stereo channels and as such may be driven by a single (left–right) input signal.

The one or more second transducers may be driven so as to reproduce two audio signals (e.g. left–right and right–left), substantially out of phase with each other, from a single input signal, as known in the art. Preferably, the second transducer is arranged to transmit the two out of phase signals in substantially opposite directions. The two signals are preferably substantially 180 degrees out of phase.

The apparatus further comprises a duct associated with the one or more second transducers. The duct is arranged to conduct the signal generated by the one or more second transducers such that it is transmitted along a direction substantially parallel to the output plane from a point spaced from the output plane in the direction in which the sum signal is transmitted. By arranging a duct in this way, it is found that the physical spacing between the one or more first and second transducers may be reduced, so as to thereby advantageously minimise the overall size and profile of the apparatus.

Preferably, the duct comprises two openings that face in substantially opposite directions. The one or more second transducers are disposed within the duct, such that one of the out of phase signals is transmitted via one of the openings and the other out of phase signal is transmitted via the other opening. The duct may be arranged to direct the out of phase signals in directions substantially parallel to the output plane and spaced from the output plane in the direction of the reproduced signal of the one or more first transducers.

Out of phase signals are inherently apt to interfere with each other and cancel each other out. The effect of this is to impair the quality of the difference signal, leading to an unsatisfactory reproduction of the stereo sound. However, as the out of phase difference signals in the present apparatus are transmitted from two spaced apart locations, the problem of cancellation is overcome, or at least greatly reduced.

The apparatus may comprise an enclosure in the form of a housing or frame, into which the first and second (or more) transducers are mounted, together with the duct. The enclosure may be made from a relatively lightweight material, such as plastic or wood. The one or more first and second transducers are preferably arranged within the enclosure so that they are mounted proximate to each other, in an adjacent arrangement. Due to this arrangement and operation of the duct, the need to locate the one or more second transducers generally behind the one or more first transducers may be avoided, thereby reducing the overall physical size of the enclosure, which consequently minimizes its depth profile. By 'depth profile' we mean the width dimension between the front and rear of the enclosure.

Hence, a speaker enclosure according to the present invention is found to be significantly smaller in size relative to known stereo enclosures or mountable speaker units, and as a result is particularly suited for use as a 'flat panel type' speaker enclosure, which may be installed and mounted in listening environments where it is desired to minimise the intrusion on the aesthetic appeal or decoration of the environment.

The front face of the enclosure (i.e. the face that is directed substantially towards the listening environment and from which the sound originates) may be covered with a grill or mesh, as commonly used in the art, or alternatively may be uncovered. However, in either arrangement the front face of the enclosure may serve to define the output plane, such that it corresponds to the surface or point from which the sum signal is transmitted orthogonally to the plane.

Due to the lower depth profile, the present enclosure is also particularly suitable for partially embedding within a wall or ceiling surface, requiring less effort and time to excavate a recess within the surface to receive the enclosure. To further reduce the profile of the enclosure, the protruding baffle may be in the form of a substantially flat plate arranged so as to be parallel to the output plane, e.g. adjacent to the front face of the enclosure. In this way, the baffle does not markedly protrude beyond the enclosure and therefore may reside at, or near to, the level of any surrounding wall or ceiling surface, thereby minimizing the visible 'footprint' of the enclosure when installed within the listening environment. Hence, where the apparatus is in the form of a flat panel type enclosure, the enclosure may be installed without intrusively impinging on the aesthetic appeal of the interior decoration and without consuming valuable space within the listening area.

The benefits of the present invention are found to be especially advantageous within commercial environments, as architects and interior designers may install the enclosure without producing a noticeable effect on the listening environment. Thus, the present apparatus provides an effective solution to the problem of providing a relatively non-intrusive speaker enclosure that does not sacrifice the quality of the reproduced sound.

According to another embodiment, the one or more first transducers may be a pair of audio loudspeakers that are disposed adjacent to each other, with the one or more second transducers, preferably a dipole loudspeaker, being disposed substantially in between. Each of the pair of loudspeakers may be driven by a respective one of the left and right channels of the stereo input signal, so that one of the pair reproduces the left channel and the other reproduces the right channel. In this way, the pair of loudspeakers will reproduce a sum signal that is comprised of the separate left and right channels of the stereo signal. Alternatively, each of the pair of loudspeakers may be respectively driven by a combined signal of the left and right channels.

The pair of loudspeakers may be driven via a conventional two channel stereo amplifier or other suitable driving means.

The dipole loudspeaker may be driven by a mixed left–right signal or alternatively, the dipole transducer may be configured to be driven across the individual left and right channels of the stereo input signal. In the latter case, a difference signal may then be reproduced without the need for any electronic mixing or signal processing (e.g. polarity manipulation etc.). As a result, the use of relatively complex mixing electronics can be reduced, or avoided, as the transducers within the enclosure may be driven solely via the individual channels of the stereo input signal.

The difference signal is conducted via the duct as described in previous embodiments, such that the two out of phase components are transmitted in approximately opposite directions, substantially parallel to the output plane, from openings in the duct that serve to space the signals from the plane in the direction of the transmitted sum signal.

Consistent with one or more of the preceding embodiments, the one or more second transducers may be in the form of a pair of audio loudspeakers that are arranged substantially back-to-back, with each being disposed within a respective duct. In this arrangement, the duct comprises two adjacent portions, each suitable for conducting a respective difference signal along a direction substantially parallel to the output plane. The back-to-back loudspeakers may be driven between the left and right channels of the stereo input signal to thereby reproduce the left and right spatial information, or alternatively, each of the pair of back-to-back loudspeakers may be respectively driven by a difference signal.

Where pre-mixing and signal processing is used as part of the driving technique, the apparatus may include a sum and difference matrix to achieve this.

A high-pass filter may also be included in any of the disclosed embodiments, so that the amount of low frequency information reproduced by the one or more second transducers may be reduced. The reproduction of low frequency sounds from the one or more second transducers is poor compared to that of the one or more first transducers transmitting the sum signal. This is because significant cancellation of low frequencies occurs due to their inherently longer wavelengths. To compensate for this, the amplitude of the low frequencies in the left and right channels may be boosted to reinforce the amplitude of the low frequencies in the transmitted sum signal. Cutting out the low frequencies in the difference signal improves the integrity of the signal.

Although the present invention is ideally suited for reducing or minimising the size of a stereo speaker enclosure, without sacrificing the quality of the reproduced sound, it will be recognized that one or more of the principles of the invention could also be used in other sound reproduction applications where it is desired to optimize the configuration of the transducers so as to form substantially flat panel type enclosures, for example, and/or to otherwise avoid intrusion into the listening environment.

Embodiments of the invention will now be described in detail by way of example and with reference to the accompanying drawings in which:

FIG. 2(*b*) is a front plan view of the stereo speaker enclosure of FIG. 2(*a*).

Figure 1:
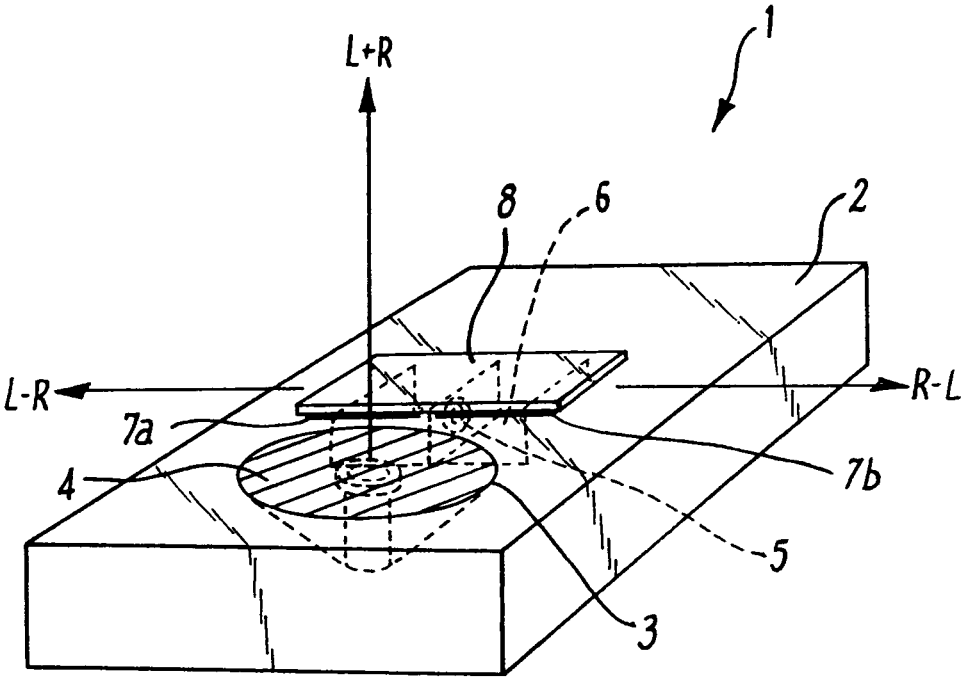
FIG. 1 is a perspective view of a stereo speaker enclosure according to one embodiment of the invention.

In the following drawings where the terms front, rear, top, bottom, left side, right side and like terms are used they refer to directions relative to the apparatus as illustrated and/or to any of its intended orientations of use, be it mounted to, or installed in, a wall or ceiling surface etc. The terms are used for Convenience only and are not intended to be otherwise limiting. In the drawings, like reference numerals are used throughout to identify like or corresponding components.

Referring to FIG. 1, there is shown a preferred embodiment of a stereo reproduction apparatus 1 according to the present invention. The apparatus is in the form of a single, self-contained 'flat panel type' enclosure, comprising a generally rectangular housing 2 made from a rigid plastic. Mounted inside the housing 2 is an audio loudspeaker 3 of conventional design. The loudspeaker 3 is mounted so that its sound emitting surface is parallel to the front face of the housing 2. By 'front face' we mean the surface that faces towards the listening environment.

An aperture is included within the front face, adjacent to, and coincident with, the location of loudspeaker 3. Any audio signal produced by the loudspeaker 3 is therefore directed outwardly through the aperture and into the listening environment. In the example of FIG. 1, the loudspeaker 3 is driven by the combined left and right channels of a stereo input signal, so as to reproduce a sum signal indicated by 'L+R'. Hence, the front face of the housing 2 serves to define an output plane from which a sum signal is transmitted in a direction that is substantially orthogonal to the plane. A grill or fabric mesh 4 can be used to cover the aperture and loudspeaker 3, as conventionally known in the art.

A dipole loudspeaker 5, of a type having a frusto-conical diaphragm, is also mounted within the housing 2, such that it is adjacent to the loudspeaker 3, i.e. they are mounted approximately side-by-side. The dipole loudspeaker 5 is oriented so that its axis is orthogonal to the axis of the loudspeaker 3. In other words, the front and rear surfaces of the dipole loudspeaker 5 are parallel to the left and right sides of the housing 2, respectively.

The dipole loudspeaker 5 is disposed within a duct 6 inside of the housing 2. The duct 6 is generally rectangular in shape and is partitioned into two approximately equal portions, each portion arranged to conduct an audio signal from the dipole loudspeaker 5 to a respective opening 7*a* and 7*b* in the front face of the housing 2. In the example of FIG. 1, the dipole loudspeaker 5 is driven so as to produce two 180 degrees out of phase difference signals (indicated by 'L−R' and 'R−L' in FIG. 1) that are transmitted in approximately opposite directions. By action of the partitioned duct 6, one of the out of phase signals is conducted to opening 7*a*, while the other is conducted to opening 7*b*. In this way, the out of phase difference signals may then be transmitted externally to the housing 2, in front of, and across, the output plane, along directions that are parallel to the plane. In this way, the transmitted sum and difference signals may then combine to reproduce a high quality stereophonic sound field within the listening environment.

To further control the directionality of the transmitted difference signals, a baffle 8 in the form of a flat, generally rectangular, plate is fixed just above the duct 6, external to the housing 2. The size of the openings 7*a*, 7*b* are defined by the baffle 8, in that if the baffle 8 is fixed close to the front face of the housing 2, the openings 7*a*, 7*b* will be narrow or thin, whereas wider openings 7*a*, 7*b* can be achieved by spacing the baffle 8 further from the front face. In accordance with the present invention, the function of the duct 6 and baffle 8 is to conduct the difference signals such that they are transmitted (and initially constrained) within a region adjacent to the output plane in front of the loudspeaker 3, as shown in FIG. 1.

Of course, it is to be appreciated that the benefits of the invention may be achieved by way of any suitable duct, baffle or configuration of openings, depending on the particular transducer arrangement and desired quality of reproduced sound.

By using a duct 6 and baffle 8 in this way, it is possible to position the dipole loudspeaker 5 alongside the loudspeaker 3, which consequently reduces the depth profile of the housing 2. Hence, the enclosure may be made thinner relative to known stereo enclosures in which the dipole transducer is located generally behind a front facing loudspeaker.

Although not shown in FIG. 1, during use, the loudspeaker 3 and dipole loudspeaker 5 are driven by respective stereo input signals that have been processed via a conventional sum and difference matrix. The stereo signals are fed to the loudspeaker 3 and dipole loudspeaker 5 by way of respective audio power amplifiers, as commonly known in the art.

Figure 2A:
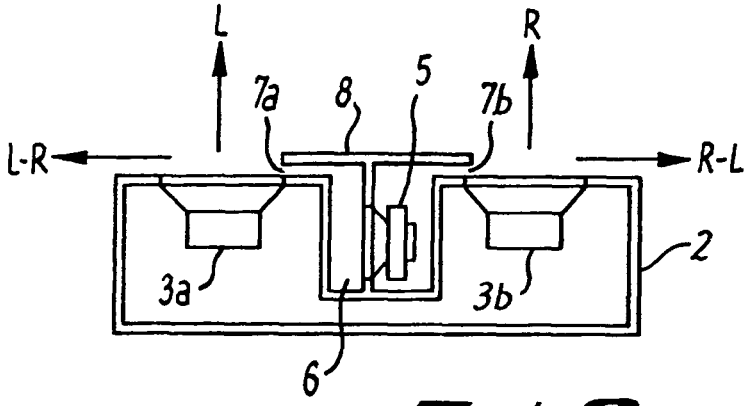
FIG. 2(*a*) is a top cross-sectional view of another stereo speaker enclosure according to a different embodiment of the invention.
Figure 2B:
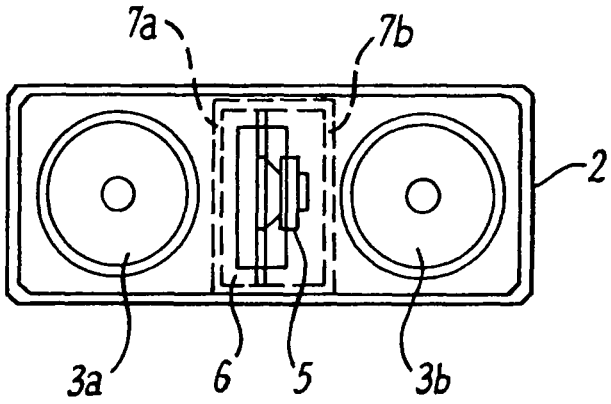

Referring now to FIGS. 2(*a*) and 2(*b*), there is shown another example of an apparatus according to the present invention. In this arrangement, the loudspeaker 3 has been replaced by a pair of conventional audio loudspeakers 3*a* and 3*b*, that are adjacently disposed at the front face of the housing 2. The front face serves to define an output plane from which a sum signal is transmitted substantially orthogonally to the plane. Each of the pair of loudspeakers 3*a*, 3*b* is driven by a respective one of the left and right channels of the stereo input signal. In this way, during use, the pair of loudspeakers 3*a*, 3*b* will produce a sum signal that is transmitted into the listening environment.

A dipole loudspeaker 5 is mounted between the pair of loudspeakers 3*a*, 3*b* such that its axis is orthogonal to the axes of the loudspeakers 3*a*, 3*b*. The dipole loudspeaker 5 is disposed in a generally rectangular duct 6, partitioned into two portions, as in the manner of the previous example. A baffle 8 is fixed above the duct 6 to define two, spaced apart, openings 7*a*, 7*b* which allow the difference signals produced by the dipole loudspeaker 5 to be transmitted in approximately opposite directions, external to the housing 2.

The dipole loudspeaker 5 is driven by a mixed left–right stereo signal so as to produce two 180 degrees out of phase difference signals, one of which is conducted to opening 7*a* and the other is conducted to opening 7*b*. The action of the duct 6 and baffle 8 causes the difference signals to be transmitted along directions substantially parallel to the output plane and in front of the pair of loudspeakers 3*a*, 3*b*. In this way, the out of phase difference signals are transmitted across the respective sound emitting surfaces of the loudspeakers 3*a* and 3*b*, orthogonal to the left and right audio signals, as shown in FIG. 2(*a*).

Figure 3:
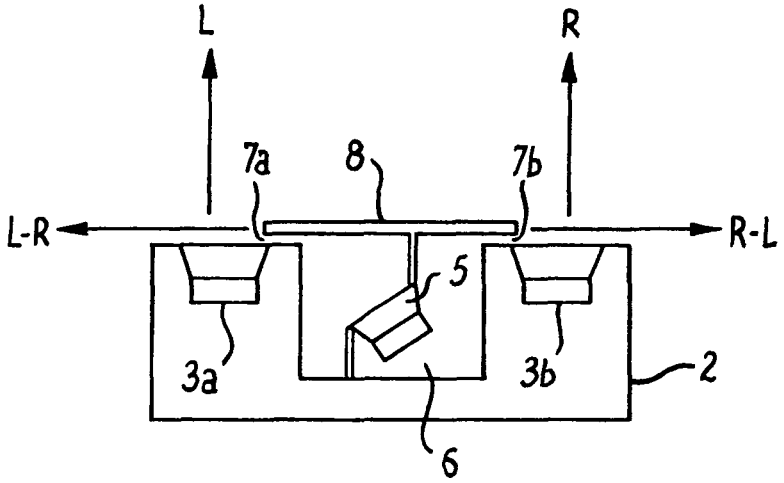
FIG. 3 is a top cross-sectional view of a different arrangement of the stereo speaker enclosure of FIG. 2(*a*).

Referring to FIG. 3, there is shown a variation of the apparatus of FIGS. 2(*a*) and 2(*b*). The functionality and operation of this example is identical to the previous arrangement. However, in order to further reduce the depth profile of the enclosure, the dipole loudspeaker 5 is mounted within the housing 2 at an angle. In this way, the dipole loudspeaker can be located closer to the front face of the housing 2, which significantly reduces the depth of the enclosure and thereby minimises the overall physical size of the enclosure. In this example, only a straight-forward modification to the partitioning within the duct 6 is required. The housing 2 itself may consequently be reduced in size as desired.

Figure 4:
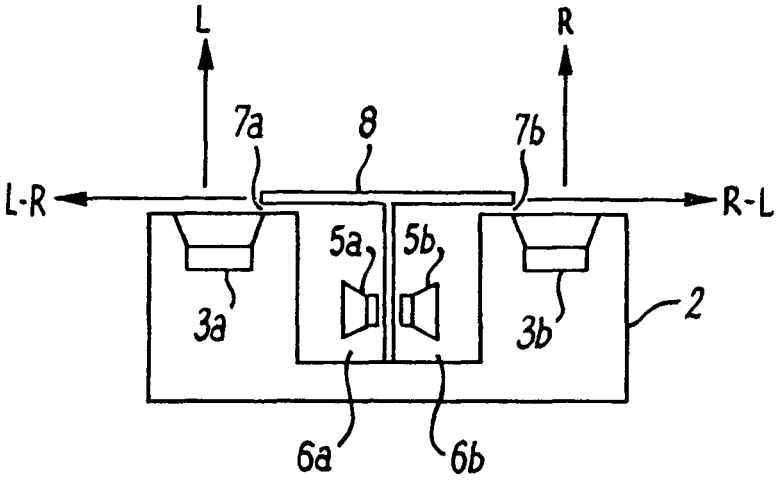
FIG. 4 is a top cross-sectional view of a further stereo speaker enclosure according to another embodiment of the invention.

In the example of FIG. 4, the dipole loudspeaker has been replaced by a pair of conventional audio loudspeakers 5*a* and 5*b*, effectively disposed back-to-back, each within a respective duct 6*a*, 6*b*. Each loudspeaker 5*a*, 5*b* may be driven by a respective one of the left and right channels of the stereo input signal, so as reproduce the spatial information. The baffle 8 is arranged as described in relation to the example in FIGS. 2(*a*) and 2(*b*)

It is to be appreciated that any of the above examples may be driven via any suitable audio driver according to established sum and difference processing techniques and hence, any of the given driving examples may be used interchangeably with the above arrangements and thus, none are intended to be limiting. In particular, the arrangement of loudspeakers may be configured such that no electronic mixing is required and therefore, the sum and difference loudspeakers can be driven solely by way of the individual left and right channels of the stereo input signal.

Figure 5:
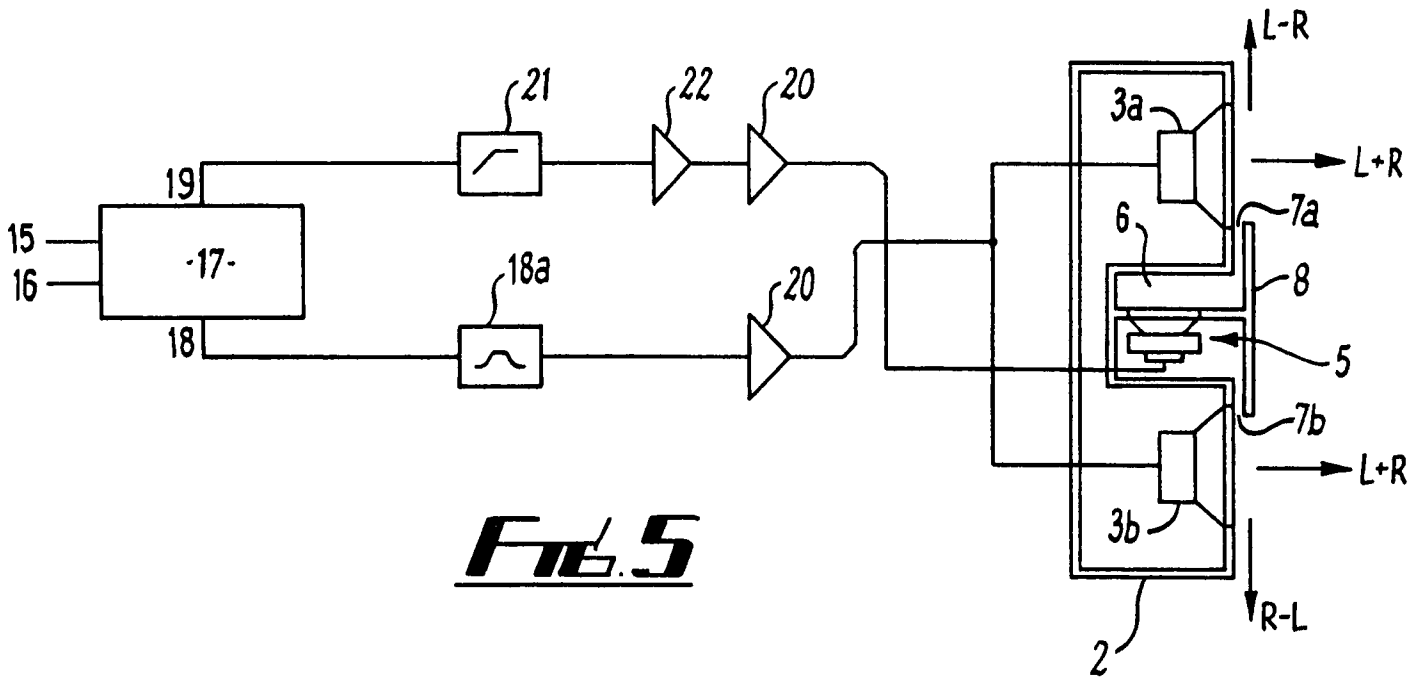
FIG. 5 is a schematic view of an example electronic circuit for driving the enclosure of FIG. 2(*a*).

In FIG. 5, there is shown an example electronic circuit that can be used to drive any of the embodiments of the present invention. As shown in FIG. 5, the circuit is being used to drive the enclosure of FIG. 2(*a*), such that the loudspeakers 3*a* and 3*b* are each driven by a combined sum signal, as opposed to separate left and right channels respectively.

The circuit comprises two inputs 15, 16 connected to a sum and difference matrix 17. The matrix 17 is arranged to produce two outputs: a sum output at 18 which comprises the sum of the inputs at 15 and 16 (15+16); and a difference output at 19 which comprises the difference of the inputs at 15 and 16 (15−16).

The sum output 18 is connected to a bass lift compensation circuit 18*a*. This adds a gain of about 3 dB to low frequency components of the signal, typically frequencies between 40 and 500 Hz. The output of the bass lift compensation circuit 18*a* is connected via a power amplifier 20 to the loudspeakers 3*a* and 3*b* disposed at the front face of the housing 2.

The difference output 19 is connected to a high pass filter 21 operative to reduce the amplitude of frequencies below 100 Hz by at least 3 dB. The filtered signal is then subjected to a gain make up of about 4 dB by an amplifier 22, the output of which is connected via a power amplifier 20 to the dipole loudspeaker 5 disposed within the duct 6.

The power amplifier 20 associated with the dipole loudspeaker 5 need only have around 10% to 20% of the power output of that associated with the sum loudspeakers 3*a*, 3*b*.

Figure 6:
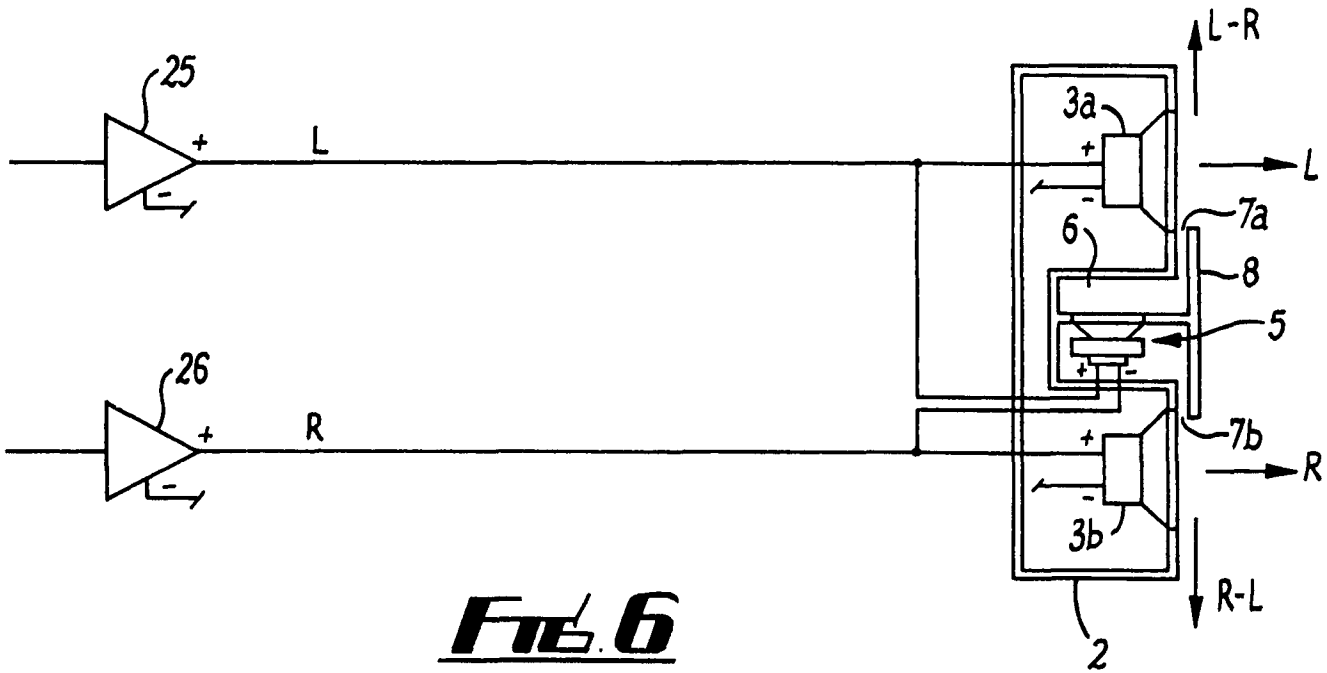
FIG. 6 is a schematic view of an alternative circuit for driving the enclosure of FIG. 2(*a*).

Referring now to FIG. 6, there is shown an alternate driving circuit which may again be used with any of the given examples, but without the need for any pre-mixing of the left and right channels of the stereo input signal. As shown in FIG. 6, the circuit is arranged to drive the enclosure of FIG. 2(*a*).

To avoid the need for a sum and difference matrix, the pair of loudspeakers 3*a*, 3*b*, together with the dipole loudspeaker 5, are simply driven by the positive outputs of two conventional power amplifiers 25, 26. One of the amplifiers 25 (herein the 'left amplifier'), provides the left channel of the stereo input signal, while the other amplifier 26 (herein the 'right amplifier'), provides the right channel of the stereo input signal.

The positive terminal of loudspeaker 3*a* is connected to the left amplifier 25 and is driven by the left channel of the stereo input signal. Correspondingly, the positive terminal of loudspeaker 3*b* is connected to the right amplifier 26 and is driven by the right channel of the stereo input signal. During use therefore, the outputs of the pair of loudspeakers 3*a*, 3*b* reproduce a sum signal that is transmitted into the listening environment. It is to be understood that, in this example, the resulting sum signal is produced without any pre-mixing step or matrixing of the left and right channels prior to driving the loudspeakers 3*a*, 3*b*.

The dipole loudspeaker 5 is connected so that the positive terminal of the loudspeaker is connected to the positive output of the left amplifier 25 and the negative terminal is connected to the positive output of the right amplifier 26. The effect of connecting the dipole loudspeaker 4 in this way, allows the loudspeaker to be driven by the positive legs of the both the left and right amplifiers 25, 26, with the result that the dipole loudspeaker 5 reproduces a difference signal without the need for any matrixing of the left and right channels of the stereo input signal.

The above arrangement may also be used in arrangements where the second transducer is in the form of a pair of back-to-back loudspeakers, such that the positive terminal of each of the pair is connected to a positive terminal of a respective one of the left and right amplifiers and the negative terminals of the loudspeakers are connected together.

The above embodiments are described by way of example only. Many variations are possible without departing from the invention.

The invention claimed is:

1. An apparatus for reproduction of stereo sound from a two channel signal, comprising:

a housing having a front face defining an output plane;

one or more first transducers mounted within the housing and behind and directed to the front face for reproducing an audio signal comprising one of, or a sum of, two channels of the two channel signal and configured to transmit the reproduced audio signal from the front face of the housing in a forward direction substantially orthogonal to the output plane;

one or more second transducers mounted within the housing and behind the front face of the housing for reproducing an audio signal comprising the difference between the two channels of the two channel signal; and a duct partially formed by and positioned in front of the front face, the duct being associated with, and extending from, the one or more second transducers to openings in front of the front face of the housing, the duct being configured to conduct the audio signal reproduced by the one or more second transducers such that the audio signal reproduced by the one or more second transducers is transmitted in the duct to the openings along a direction substantially parallel to the output plane from a point spaced in front of the output plane in the forward direction in which the audio signal reproduced by the one or more first transducers is transmitted.

2. The apparatus as claimed in claim 1: wherein the one or more first transducers and the one or more second transducers are arranged within the housing so that the one or more first transducers and the one or more second transducers are mounted proximate to each other, in an adjacent arrangement and the one or more second transducers is arranged at an angle relative to the output plane so that the one or more second transducers can be located closer to a front of the enclosure, such that a depth profile of the housing is minimized.

3. The apparatus as claimed in claim 1, wherein, the duct extends to the openings having two openings in front of the front face of the housing and the two openings face in substantially opposite directions.

4. The apparatus as claimed in claim 1, wherein the one or more second transducers are driven to reproduce two audio signals substantially out of phase with each other.

5. The apparatus as claimed in claim 4, wherein the duct extends to the openings having two openings in front of the front face of the housing and the two openings face in substantially opposite directions, and the one or more second transducers are disposed within the duct such that one of the out of phase signals is transmitted via one of the two openings and the other out of phase signal is transmitted via the other of the two openings.

6. The apparatus as claimed in claim 4, wherein the duct comprises the openings having two openings that face in substantially opposite directions, and the duct is arranged to direct the out of phase signals in directions substantially parallel to the output plane and spaced from the output plane in the forward direction of the reproduced audio signal of the one or more first transducers.

7. The apparatus as claimed in claim 1, wherein the apparatus comprises two first transducers which are disposed adjacent to each other and the one or more second transducers are disposed substantially in between the two first transducers.

8. The apparatus as claimed in claim 1, wherein the one or more second transducers is a bi-directional loudspeaker.

9. The apparatus as claimed in claim 1, wherein the one or more second transducers is a pair of loudspeakers arranged substantially back-to-back and the duct comprises two adjacent portions, each suitable for conducting a respective signal along a direction substantially parallel to the output plane.

10. The apparatus as claimed in claim 1, further comprising a high-pass filter associated with the one or more second transducers so that an amount of low frequency information reproduced by the one or more second transducers may be reduced.

11. The apparatus as claimed in claim 1 further comprising a baffle disposed in front of the output plane just in front of the duct, the baffle partially defining the openings from which the signal generated by the one or more second transducers is transmitted.

12. The apparatus as claimed in claim 1, wherein the one or more first transducers are mounted behind the front face of the housing.

13. The apparatus as claimed in claim 1, wherein the duct extends through the front face of the housing.

14. A method for reproduction of stereo sound from a two channel stereo signal, comprising:

providing one or more first transducers for reproducing an audio signal comprising one of, or the sum of, two channels of the two channel stereo signal, the one or more first transducers being mounted in a housing and the housing having a front face which defines an output plane and the one or more first transducers being located behind and directed to the front face of the housing;

providing one or more second transducers for reproducing an audio signal comprising the difference between the two channels of the two stereo channel signal, the one or more second transducers being mounted in the housing and behind the front face;

transmitting the audio signal reproduced by the one or more first transducers from the front face of the housing in a forward direction substantially orthogonal to the output plane; and conducting the audio signal reproduced by the one or more second transducers, via a duct partially formed by and positioned in front of the front face, and associated with, and extending from, the one or more second transducers to openings in front of the front face of the housing, such that the audio signal reproduced by the one or more second transducers is transmitted in the duct to the openings along a direction substantially parallel to the output plane from a point spaced in front of from the output plane in the forward direction in which the audio signal reproduced by the one or more first transducers is transmitted.

* * * * *